United States Patent [19]

Henderson

[11] Patent Number: 4,658,424

[45] Date of Patent: Apr. 14, 1987

[54] SPEECH SYNTHESIS INTEGRATED CIRCUIT DEVICE HAVING VARIABLE FRAME RATE CAPABILITY

[75] Inventor: Alva E. Henderson, Lubbock, Tex.

[73] Assignee: Texas Instruments Incorporated, Dallas, Tex.

[21] Appl. No.: 240,685

[22] Filed: Mar. 5, 1981

[51] Int. Cl.[4] ..... G10L 5/00

[52] U.S. Cl. ..... 381/51

[58] Field of Search ..... 179/1.5 M, 1.5 A, 15.55 R, 179/15.55 T; 364/513, 718

[56] References Cited

U.S. PATENT DOCUMENTS 2,771,509 11/1956 Dudley et al. ..... 179/1.5 A 4,209,836 5/1981 Wiggins et al. ..... 364/718

OTHER PUBLICATIONS

Cole et al, "A Real-Time . . . Vocoder", IEEE Conf. Record on Acoustics, etc., 1977, pp. 429-430.

Viswanathan et al, "The Application of a Functional . . . Systems", IEEE Conf. Record on Acoustics, etc., 1977, pp. 219-222.

*Primary Examiner*—E. S. Matt. Kemeny

*Attorney, Agent, or Firm*—William E. Hiller; James T. Comfort; Melvin Sharp

[57] ABSTRACT

An integrated circuit device or chip digitally synthesizes human speech employing a linear predictive filter and a variable frame rate. The variable frame rate provides a more natural speech by slowing or speeding the frame rate for a particular application used in a system which constructs the speech data to be synthesized from allophone codes.

1 Claim, 4 Drawing Figures

SPEECH SYNTHESIS INTEGRATED CIRCUIT DEVICE HAVING VARIABLE FRAME RATE CAPABILITY

BACKGROUND OF THE INVENTION

This invention relates to implementation of a digital speech synthesis circuit onto a miniature electronic device or chip.

This invention is an improvement over the invention disclosed in U.S. Pat. No. 4,209,836, which is hereby incorporated by reference. The integrated circuit speech synthesis device disclosed in the referenced patent uses stored parameter codes of words or phrases as input data for speech synthesis, at a fixed frame rate. The frame rate is the speed at which data is synthesized to produce speech. Each frame contains parameter data pertaining to the sound which it partially represents. Since the frame rate in the referenced patented device is fixed, the output speech is, therefore, also fixed.

In a system which uses stored parameters of allophones rather than words and phrases, a fixed frame rate tends to produce a rather mechanical-sounding speech product. Stress and intonation patterns may be inserted by varying the frame rate from allophone to allophone. The variations in frame rate would have no effect on the pitch or naturalness of the speech.

It is an object of the present invention to provide a speech synthesis device which produces a more natural-sounding speech. Another object of the present invention is to provide a speech synthesis device which may find application in systems employing the allophone coding technique for speech construction in a speech synthesis system.

SUMMARY OF THE INVENTION

This disclosure incorporates all of the features of the referenced patented device, and adds a novel feature which significantly improves the quality of the speech product of the device, from the aspect of the speech product having a natural sound.

To accomplish this improvement, the referenced patented device is operated as disclosed, but within a system incorporating a controller, such as a microprocessor. The controller furnishes to the synthesizer a control signal that is used within the synthesizer to alter the timing signals, and as a result, the frame rate. The frame rate may be altered for each succeeding frame, as indicated by the signal from the controller.

DETAILED DESCRIPTION OF THE INVENTION

Figure 1A:
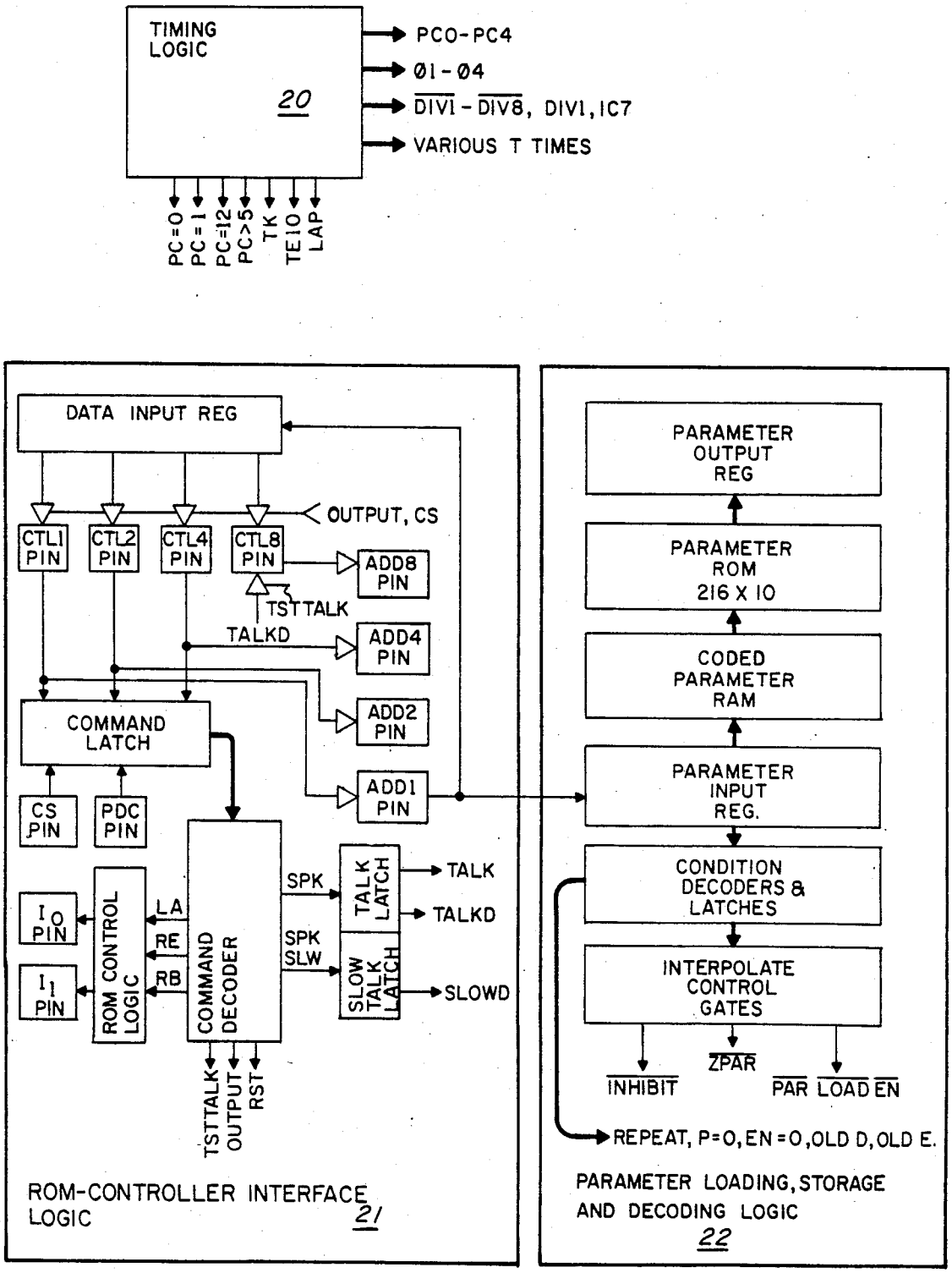
Fig. 1a PRIOR ART
FIGS. 1*a* and 1*b* are block diagrams of the speech synthesis device disclosed in the referenced U.S. Pat. No. 4,209,836.
Figure 1B:
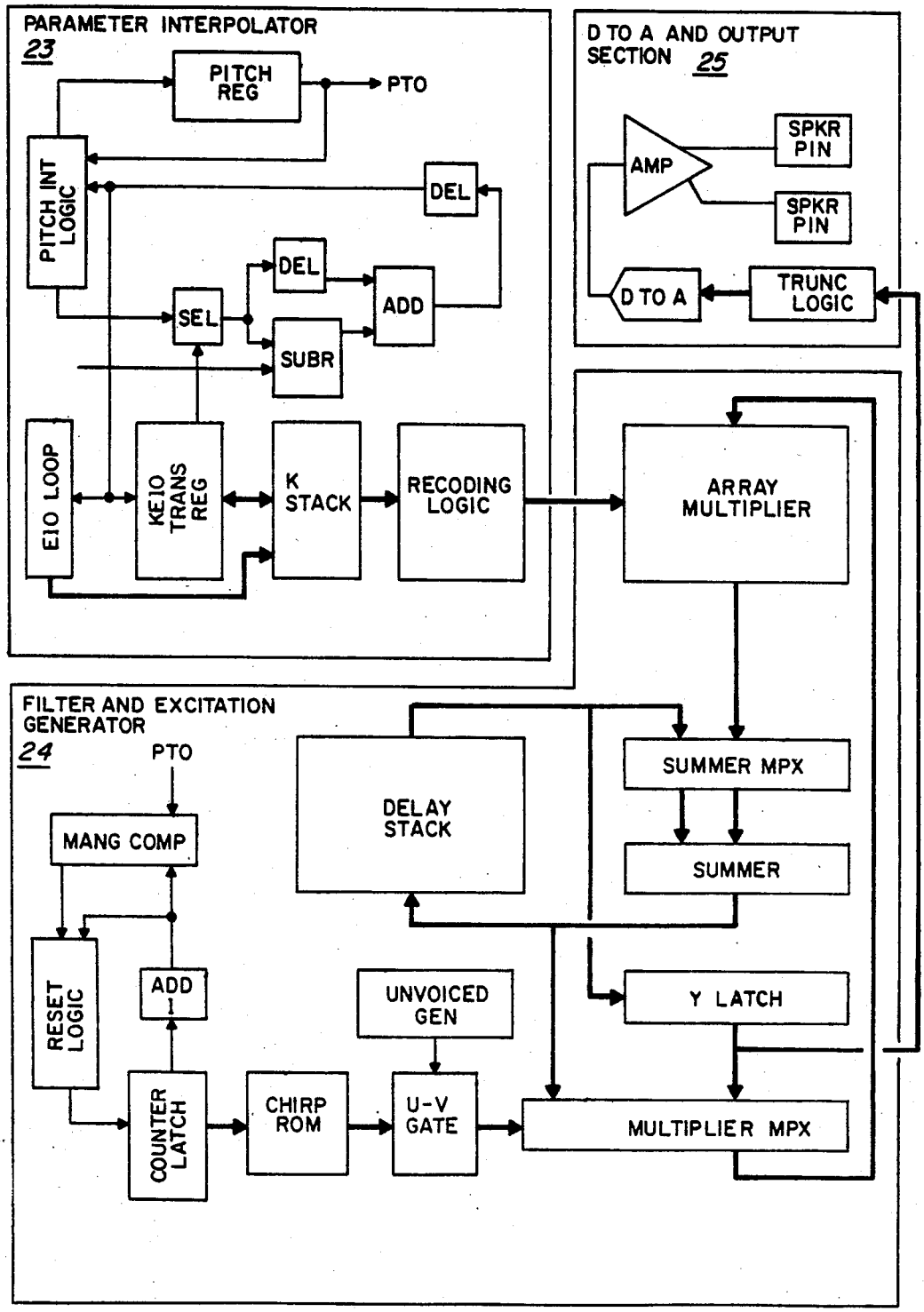
Fig. 1b PRIOR ART

FIGS. 1*a* and 1*b* are block diagrams of an embodiment of the present invention. The operation of this implementation is described in referenced U.S. Pat. No. 4,209,836.

Figure 2:
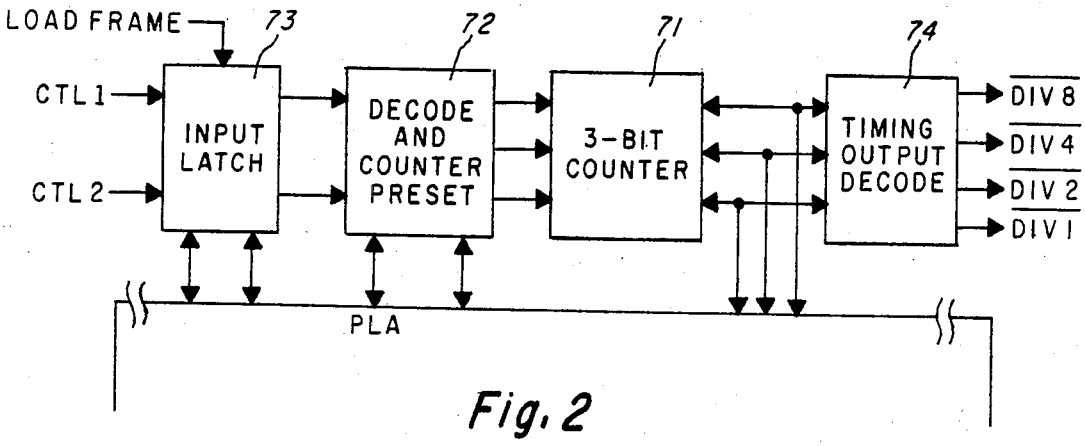
FIG. 2 is a block diagram of the modified area of the timing circuitry.

FIG. 2 is a block diagram of the logic modified to accept signals from an external source such as a controller. The input control signals CTL 1 and CTL 2 are latched into input 73 by Load Frame, an internal signal which also loads input frame data in another part of the device. The signals are in binary code, and are decoded by a decode and counter preset circuit 72. The counter preset outputs load 3-bit counter 71 to the value determined by the control inputs. The 3-bit counter 71 is incremented to 000, and at that point the PLA outputs are decoded by the timing output decoder. The decode may produce DIV 1, DIV 2, DIV 4, or DIV 8, the signal produced being indicative of the selected frame rate.

Figure 3:
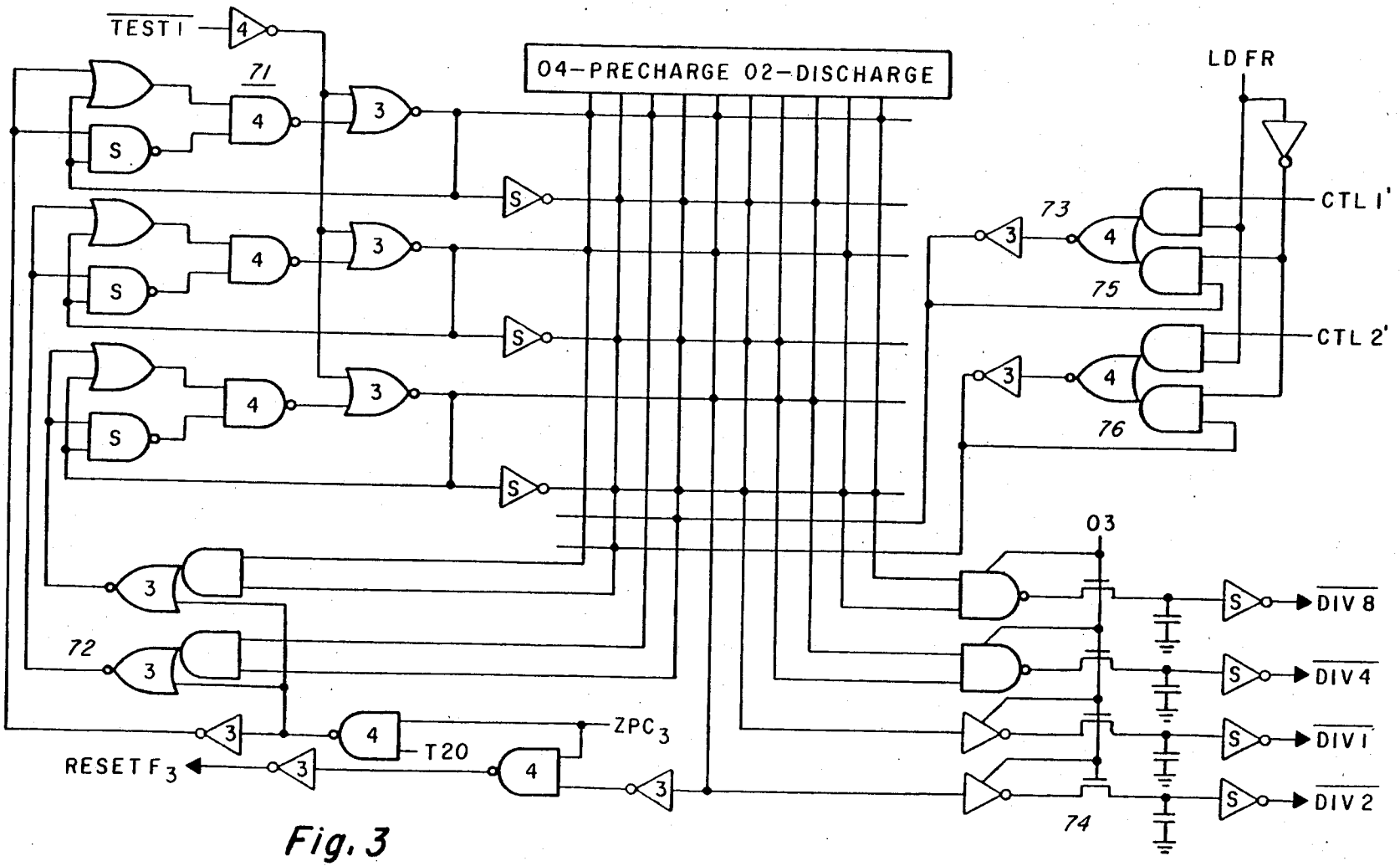
FIG. 3 is a logic diagram of the modified area of the timing circuitry.

FIG. 3 is the actual logic as implemented in the device. As previously mentioned, CTL 1 and CTL 2 are latched into input latches 75 and 76. The signals are then input to the decode and counter preset 72. Three-bit counter 71 is preset as previously mentioned, and incremented by a signal ZPC 3 from the parameter counter. The outputs of the counter and the PLA are decoded by the timing output decoder 74 to produce one of four signals, DIV 1, DIV 2, DIV 4, or DIV 8 to indicate the frame speed for the frame just loaded.

The advantages of a variable frame rate are mainly in the flexibility it offers in the application of a device having this capability to a system. For example, a visually handicapped person might wish to have a faster rate of speech to speed up his intake of information. Conversely, a slower rate may be desirable in a learning aid wherein words may be slowly pronounced. In communications, a high rate of digital speech data for transmission would be desirable for economic reasons when time is a factor, as is the case for most types of data links.

What is claimed is:

1. A speech synthesis system comprising:

speech synthesizer means for receiving frames of digital speech data comprising binary representations of speech parameter data including pitch data, energy data and reflection coefficient data and converting said frames of digital speech data into analog signals representative of human speech;

audio means coupled to said speech synthesizer means for converting said analog signals representative of human speech into audible synthesized human speech;

means for varying the time interval during which respective frames of digital speech data are converted by said speech synthesizer means into analog signals representative of human speech, said frame rate-varying means comprising external control signal means for furnishing one of a plurality of possible control signals indicative of a corresponding plurality of different speech data frame rates; and circuit means operably coupled to said external control signal means and said speech synthesizer means for receiving said one of said plurality of control signals representative of a particular speech data frame rate from said external control signal means and adjusting the operation of said speech synthesizer means in accordance therewith for establishing the current speech data frame rate of said speech synthesizer means in accordance with said one control signal, said circuit means comprising data input means for receiving control signals from said external control signal means, decode and counter preset circuit means connected to said data input means for decoding the control signals received therefrom, a counter coupled to the output of said decode and counter preset circuit means, said counter being responsive to the decoded value of said control signals to be preset and having a plurality of bits for incrementing after the presetting thereof to provide count signal outputs, programmable logic array means for receiving said count signal outputs from said counter and providing a logic array signal output, and timing decode means connected to the output of said programmable logic array means for decoding the logic array signal output therefrom to generate a timing signal indicative of a selected one of said plurality of possible speech data frame rates utilized by said speech synthesizer means in converting said speech data frame associated with said timing signal into a corresponding analog signal representative of human speech, whereby said audio means produces audible synthesized human speech having an aural quality influenced by the respective frame rates of the speech data frames from which the audibly synthesized human speech is derived.

* * * * *